US008695820B2

(12) United States Patent
Rabie

(10) Patent No.: US 8,695,820 B2
(45) Date of Patent: Apr. 15, 2014

(54) BOTTLE CAP WITH RELEASABLE EXTERNAL FORMATIONS

(75) Inventor: Arno Rabie, Crawley (GB)

(73) Assignee: Smooth Hip Ltd, Crawley (GB)

( * ) Notice: Subject to any disclaimer, the term of this patent is extended or adjusted under 35 U.S.C. 154(b) by 0 days.

(21) Appl. No.: 13/510,677

(22) PCT Filed: Nov. 17, 2010

(86) PCT No.: PCT/ZA2010/000069
§ 371 (c)(1),
(2), (4) Date: May 18, 2012

(87) PCT Pub. No.: WO2011/063428
PCT Pub. Date: May 26, 2011

(65) Prior Publication Data

US 2012/0228257 A1 Sep. 13, 2012
US 2013/0126463 A2 May 23, 2013

(30) Foreign Application Priority Data

Nov. 20, 2009 (GB) ..... 0920297.9
Feb. 1, 2010 (GB) ..... 10011611.1
Apr. 28, 2010 (GB) ..... 1007045.6

(51) Int. Cl.
*B65D 21/036* (2006.01)
*B65D 41/34* (2006.01)

(52) U.S. Cl.
USPC ..... 215/252; 206/508; 215/228; 220/23.4

(58) Field of Classification Search
USPC ..... 215/252, 228; 220/23.4, 23.6; 206/508
See application file for complete search history.

(56) References Cited

U.S. PATENT DOCUMENTS

| | | | | |
|---|---|---|---|---|
| 3,713,247 | A | 1/1973 | Parrilla | |
| 3,815,281 | A * | 6/1974 | Kander | 446/77 |
| 4,202,456 | A | 5/1980 | Silber | |
| 5,035,234 | A * | 7/1991 | Forsythe | 601/24 |
| 5,361,919 | A | 11/1994 | Hull et al. | |
| 5,402,903 | A | 4/1995 | Mann | |
| 6,296,541 | B1 | 10/2001 | Bezalel et al. | |
| 6,702,642 | B1 | 3/2004 | Parein | |
| D683,625 | S * | 6/2013 | Miranda De Araujo et al. | D9/443 |
| 2004/0000550 | A1 * | 1/2004 | Taccolini et al. | 220/23.4 |
| 2005/0051548 | A1 * | 3/2005 | Erel | 220/23.4 |
| 2006/0261063 | A1 * | 11/2006 | Dyehouse | 220/23.4 |
| 2007/0034590 | A1 * | 2/2007 | Hidding | 215/252 |
| 2010/0065560 | A1 * | 3/2010 | DaSilva et al. | 220/23.4 |
| 2010/0185323 | A1 * | 7/2010 | Moor et al. | 700/243 |
| 2010/0308043 | A1 * | 12/2010 | Wimmer | 220/23.4 |

FOREIGN PATENT DOCUMENTS

| | | |
|---|---|---|
| JP | 200414921 | 5/2004 |
| WO | WO0205918 A1 | 1/2002 |

* cited by examiner

*Primary Examiner* — Anthony Stashick
*Assistant Examiner* — Niki Eloshway
(74) *Attorney, Agent, or Firm* — Haugen Law Firm PLLP

(57) ABSTRACT

The invention relates to a cap. More particularly, the invention relates to a bottle cap which has engaging formations which allow it to be releasably secured to other caps of the same kind. The cap includes a sleeve moulded integrally to an end wall, the sleeve having at least one line of weakness spaced apart from the end wall for separation of at least one ring portion from the sleeve. The cap further includes primary external co-operating engaging formations provided on either side of the line of weakness, such that the cap is connectible side-to-side, via the primary external cooperating engaging formations, to other caps or ring portions, or to bottles having corresponding primary external cooperating engaging formations.

19 Claims, 2 Drawing Sheets

BOTTLE CAP WITH RELEASABLE EXTERNAL FORMATIONS

FIELD OF THE INVENTION

The invention relates to a cap. More particularly, the invention relates to a bottle cap which has engaging formations which allow it to be releasably secured to other caps of the same kind.

BACKGROUND OF THE INVENTION

It is known to make bottle caps which serve as building blocks, usually for children to play with or otherwise as collectables. These caps will normally have the usual internal screw threads which are used to engage screw threads on the top of a bottle.

The exterior of the cap is provided with the cooperating engaging formations which allow several caps to be connected to form some more complex structure.

OBJECT OF THE INVENTION

It is an object of the current invention to provide a cap of the kind referred to which has additional aspects to its construction that at least partially provide advantages when the caps are used together for building.

SUMMARY OF THE INVENTION

According to the invention there is provided a cap for a bottle including:

- a sleeve moulded integrally to an end wall, the sleeve having at least one line of weakness spaced apart from the end wall for separation of at least one ring portion from the sleeve; and
- primary external cooperating engaging formations provided on either side of the line of weakness;
- such that the cap is connectible side-to-side, via the primary external cooperating engaging formations, to other caps or ring portions, or to bottles having corresponding primary external cooperating engaging formations The cap may further include secondary cooperating engaging formations such that the cap is connectible to other caps in a free end to end wall end configuration, the free end of the sleeve being opposite the end wall end thereof. Typically, the secondary cooperating engaging formations comprise radially inwardly extending teeth spaced apart inside the sleeve and located near the at least one line of weakness, and a cooperating recess provided at an outer edge of the end wall, the recess being a series of spaced apart inwardly inclined steps corresponding to the teeth in the sleeve. Preferably, the radially inwardly extending teeth inside the sleeve being exposable for the purposes of connecting the cap to other caps only after separating the ring portion from the sleeve.

The secondary cooperating engaging formations are typically press fit clipping formations, the teeth and the inclined steps being capable of releasably clipping to one another. Alternatively, the secondary cooperating engaging formations are twist fit formations, the teeth and the inclined steps being releasably securable by applying a relative twist action to the caps being connected or to the cap and ring portion being connected.

Typically, the primary external cooperating engaging formations extend longitudinally on the sleeve in the form of consecutive male and female engaging formations. Preferably, the male engaging formations are ridges extending radially outwardly from the cap and the female engaging formations are defined by the spacing between consecutive male engaging formations, the male engaging formations being slidably receivable within the female engaging formations for the purposes of connecting the cap to other caps, ring portions and/or bottles. More preferably, the female engaging formations are wedge shaped grooves.

The at least one line of weakness may be a transversely extending annular line of weakness. Alternatively, the at least one line of weakness is castellated such that a castellated formation remaining on the cap and the ring portion after separation form the teeth of the secondary cooperating engaging formations.

Typically, the ring portion comprises internal barbs to engage an annular protrusion around a bottle neck.

Preferably, the primary external cooperating engaging formations comprise sufficient strength to withstand breaking from the cap under forces the cap is exposable to during an automated bottle capping process.

According to a second aspect of the invention there is provided a cap for a bottle including:

- a sleeve moulded integrally to an end wall, the sleeve having at least one line of weakness spaced apart from the end wall for separation of at least one ring portion from the sleeve;
- primary external cooperating engaging formations located between the at least one line of weakness and the end wall end of the sleeve, the primary external cooperating engaging formations enabling the cap to be connected to other similar caps in a side-to-side configuration, and
- secondary cooperating engaging formations in the form of radially inwardly extending teeth spaced apart inside the sleeve and located near the at least one line of weakness, and a cooperating recess provided at an outer edge of the end wall;
- such that the teeth are exposable on the separation of the at least one ring portion from the sleeve and engagable with the recess thereby enabling the cap to connect to other similar caps in a free end to end wall end configuration, the free end of the sleeve being opposite the end wall end thereof.

The recess may be a series of spaced apart inwardly inclined steps corresponding to the teeth in the sleeve. Generally, the secondary cooperating engaging formations are press fit clipping formations, the teeth and the inclined steps being capable of releasably clipping to one another. Alternatively, the secondary cooperating engaging formations are twist fit formations, the teeth and the inclined steps being releasably securable by applying a relative twist action to the caps being connected or to the cap and ring portion being connected.

Typically, the at least one ring portion includes primary external cooperating engaging formations such that before separation, the primary external cooperating engaging formations are provided on either side of the line of weakness. Preferably, the primary external cooperating engaging formations extend longitudinally on the sleeve in the form of consecutive male and female engaging formations.

More preferably, the male engaging formations are ridges extending radially outwardly from the cap and the female engaging formations are defined by the spacing between consecutive male engaging formations, the male engaging formations being slidably receivable within the female engaging formations for the purposes of connecting the cap to other caps, ring portions and/or bottles. Most preferably, the female engaging formations are wedge shaped grooves.

The at least one line of weakness may be a transversely extending annular line of weakness. Alternatively, the at least one line of weakness is castellated such that a castellated formation remaining on the cap and the ring portion after separation form the teeth of the secondary cooperating engaging formations.

Generally, the ring portion comprises internal barbs to engage an annular protrusion around a bottle neck, such that when the cap is twisted for the purposes of opening the bottle, the bards resist the twist motion causing the cap to break along the line of weakness thereby providing a visual aid that the bottle and/or cap have been tampered with. In a preferred embodiment, the primary external cooperating engaging formations comprise sufficient strength to withstand breaking from the cap under forces the cap is exposable to during an automated bottle capping process.

According to a third aspect of the invention, there is provided a bottle comprising a cap having the abovementioned features. Typically, the bottle includes the primary external cooperating engaging formations such that the bottle is connectible side-to-side, via the primary external cooperating engaging formations, to other bottles, caps or ring portions. Preferably, the bottle includes indicia advising consumers that a collection of bottles and/or caps can be used together as building components.

BRIEF DESCRIPTION OF THE DRAWINGS

The invention will now be described in more detail, by way of example only, with reference to the accompanying drawings in which.

DETAILED DESCRIPTION OF THE INVENTION

Figure 1:
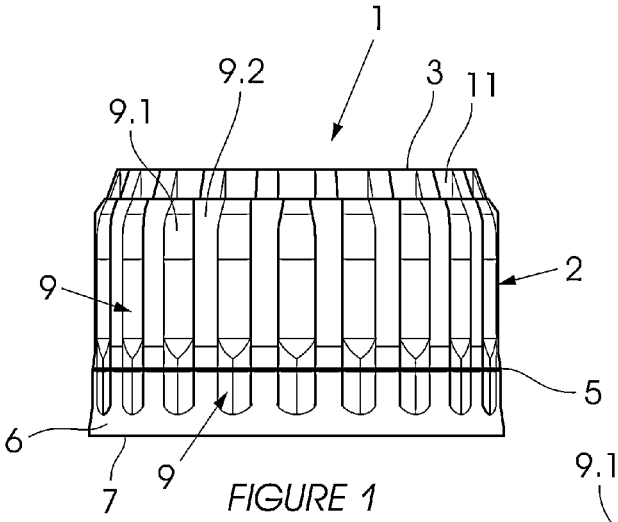
FIG. 1 shows a side view of a cap for a bottle in accordance with the present invention.
Figure 2:
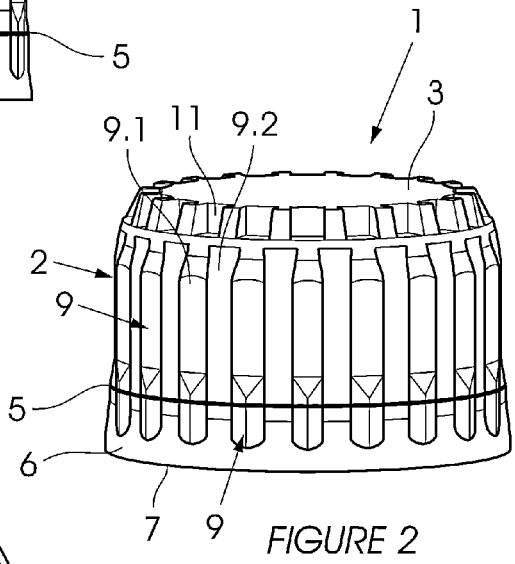
FIG. 2 shows a perspective view of the cap.

With reference to FIG. 1 and FIG. 2, a cap (1) for a bottle according to a preferred embodiment of the invention, is preferably moulded integrally from plastics material. The bottle cap (1) has a sleeve (2) extending from an end wall (3). The sleeve (2) is provided with the usual internal screw threads (4) for use with a correspondingly screw threaded bottle (not shown).

A transversely extending annular line of weakness (5) is provided in the sleeve (2). This line of weakness (5) is spaced apart from the end wall (3) and defines a ring portion (6) of the sleeve (2) adjacent its free end (7).

The line of weakness (5) allows the ring portion (6) to be separated from the main portion of the sleeve (2). The two components once they are separated will be referred to as the ring portion (6) and the cap (1).

The ring portion (6) has internal barbs (8). These barbs (8) serve to engage an annular protrusion (not shown) around a bottle neck. The ring portion (6) thus serves as a tamper evident seal, in this embodiment of the invention.

Primary external cooperating engaging formations (9) are provided on the exterior surface of the sleeve (2). The primary external cooperating engaging formation (9) may be located on both sides of the line of weakness (5) or only one of the sides thereof. These primary engaging formations (9) extend longitudinally on the sleeve as spaced apart male-like ridges (9.1). The ridges (9.1) form female-like wedge shaped grooves (9.2) between them.

The engaging formations (9) are provided to either side of the line of weakness (5), or in other words, the line of weakness (5) extends across or interrupts these formations (9).

Figure 3:
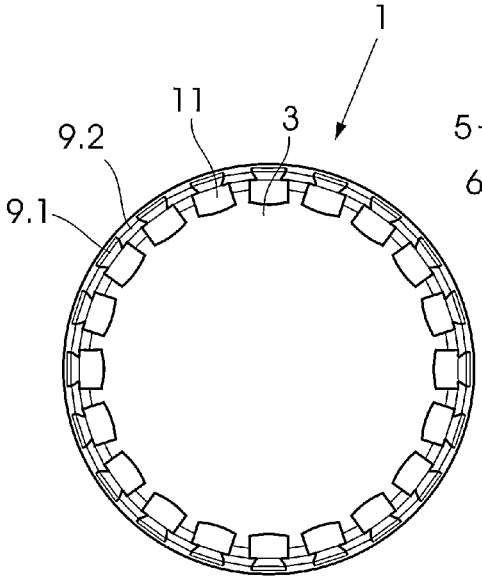
FIG. 3 shows a plan view of the cap.
Figure 4:
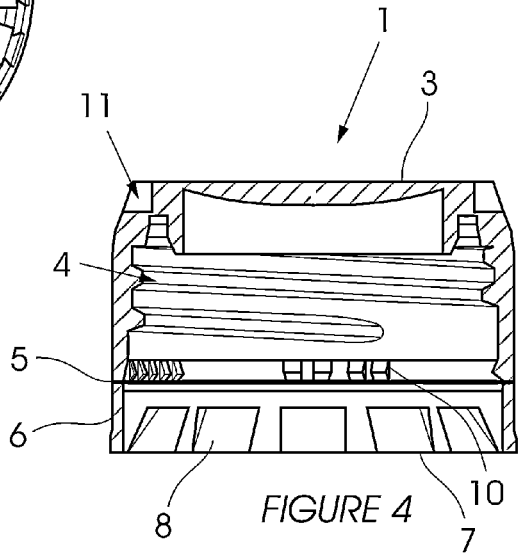
FIG. 4 shows a cross-sectional side view of the cap along line A-A.

With reference to FIG. 3 and FIG. 4, spaced apart teeth (10) are provided inside the main portion of the sleeve (2), adjacent the line of weakness (5). The teeth (10) have a cooperating recess (11) provided at the outer edge of the end wall (3). In this embodiment the recess is a series of spaced apart inwardly inclined steps (11) corresponding to the teeth (10) in the sleeve (2).

The teeth (10) are typically press fit clipping formations, the teeth (10) and the inclined steps (11) being capable of releasably clipping to one another. Alternatively, the teeth (10) and the inclined steps (11) are twist fit formations, the teeth (10) and inclined steps (11) being releasably securable by applying a relative twist action to the caps (1) being connected or to the cap (1) and ring portion (6) being connected.

The moulded cap (1) will be fitted to seal a beverage container in the usual manner as it is filled in a bottling plant. The bottles will be marketed with information advising consumers that a collection of caps (1) can be used together as building components.

The engaging formations (9) provide grip which assists in the unscrewing and opening of a bottle. This operation will shear the sleeve (2) at the line of weakness (5) and separate the ring portion (6). The ring portion (6) can then be removed from the bottle neck.

Figure 5:
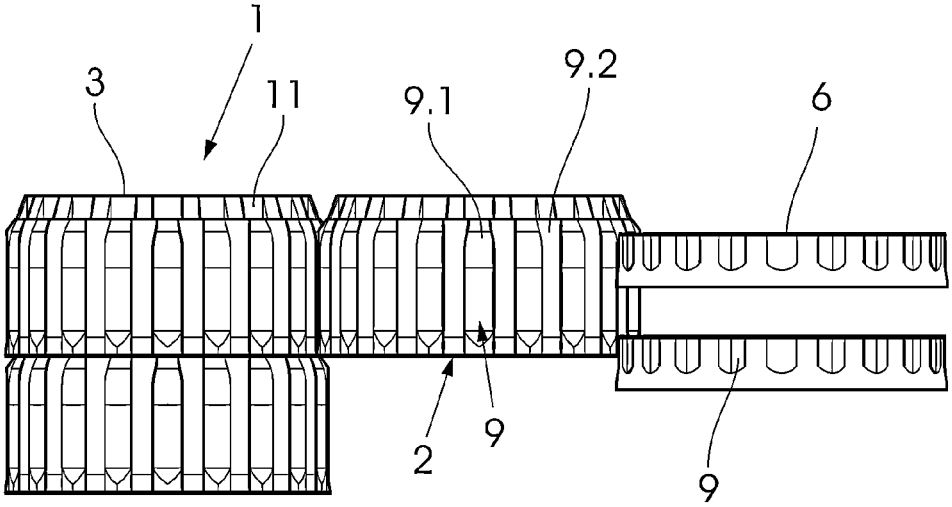
FIG. 5 shows a side view of a plurality of caps and ring portions in accordance with the present invention connected in one another in side-to-side and/or free end to end wall end configurations.
Figure 6:
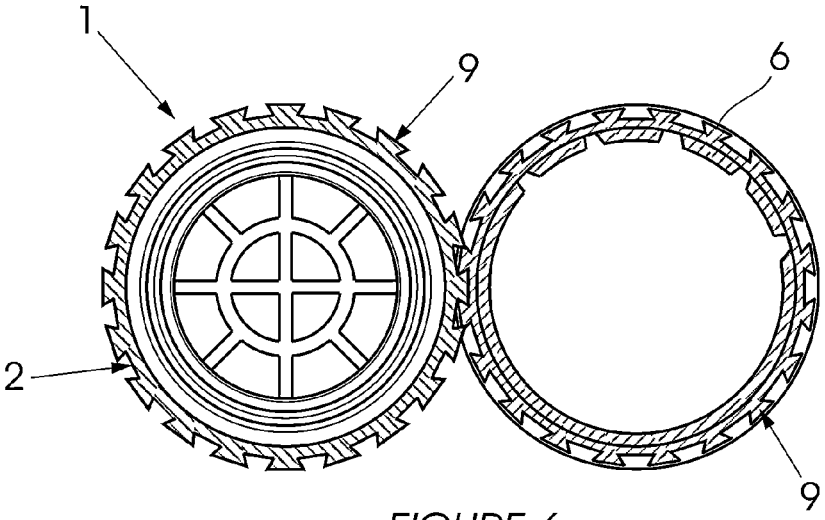
FIG. 6 shows a plan view a pair of caps in accordance with the present invention connected in a side-to-side configuration.
Figure 7:
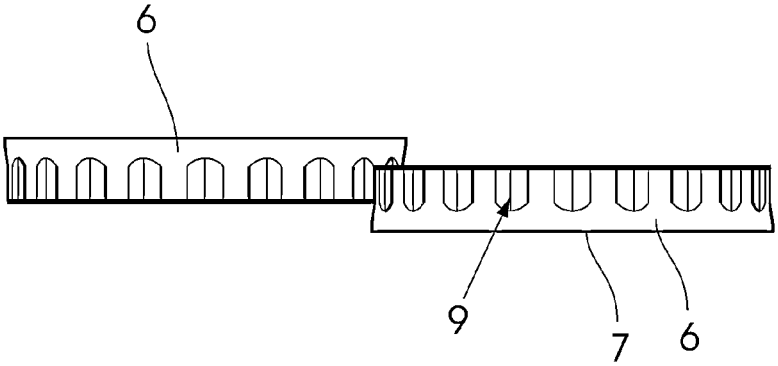
FIG. 7 shows a side view of a pair of ring portions in accordance with the present invention connected in a side-to-side configuration.

With reference now to FIGS. 5 to 7, the engaging formations (9) on the bottle caps (1) and ring portions (6) provide for releasable engagement of these components in side-to-side configurations. The teeth (10) inside the caps (1), which are suitably exposed once the ring portion (6) is removed, can be used for releasable engagement of one cap (1) on top of another cap (1) in a free end to end wall end configuration. While the ring portion (6) in this embodiment is used as a tamper evident seal, its main purpose is to provide an additional component for building as described. As such, the barbs (8) may be omitted and the proportions of the ring portion (6) may be increased. It will also be possible to have additional ring portions that can be removed from the free end of such a cap. That is, there will be more than one line of weakness but still with engaging formations to either side.

The ring portions (6) provide connectors between caps (1) when building and can also be engaged with each other. This enables a larger variety of structures from a given amount of caps. There is also some degree of flexibility in the ring portions (6) which can be used where this is required of a construction.

The line of weakness need not be annular. For example, it may also be castellated or stepped with the protrusions resulting after separation of the ring portion being used as further engaging formations or features of further engaging formations. A ring portion could also have internally extending teeth to engage a recess at the top of a cap.

With this invention, it is possible for the cap to be manufactured cost effectively using standard manufacturing processes like compression or injection moulding, and with sufficient strength to withstand the forces associated automated capping processes. The cap can also be used in a bottling plant with very few changes having to be made to the standard high-speed process. The outer formations on the cap have little to no influence on high speed bottle capping standard equipment.

It will be appreciated that the configuration of the components which allow for the releasable engagement may be varied without departing from the scope of the present invention. For example, the number and spacing of these components may obviously also be varied. Also, the inclined steps (11) may define jagged edges to better connect to the teeth (10) of an attaching cap (1). The features of a given cap will also depend on the material, dimensions and type of bottle with which it will be used.

The invention claimed is:

1. A cap for a bottle including:

a sleeve molded integrally to an end wall, the sleeve having at least one line of weakness spaced apart from the end wall for separation of at least one ring portion from the sleeve;

primary external cooperating engaging formations located between the at least one line of weakness and the end wall end of the sleeve, the primary external cooperating engaging formations enabling the cap to be connected to other similar caps in a side-to-side configuration, and secondary internal cooperating engaging formations enabling the cap to be connected to other similar caps in a free end to the end wall end configuration, wherein the free end of the sleeve is opposite the end wall end thereof, and further wherein the secondary internal cooperating engaging formations are engageable to the end wall of another similar cap only after separation of the at least one ring portion from the sleeve.

2. A cap according to claim 1, wherein the secondary cooperating engaging formations comprise radially inwardly extending teeth spaced apart inside the sleeve and located near the at least one line of weakness, and a cooperating recess provided at an outer edge of the end wall, the recess being a series of spaced apart inwardly inclined steps corresponding to the teeth in the sleeve.

3. A cap according to claim 2, wherein the radially inwardly extending teeth inside the sleeve being exposable for the purposes of connecting the cap to other caps only after separating the ring portion from the sleeve.

4. A cap according to claim 3, wherein the secondary cooperating engaging formations are twist fit formations, the teeth and the inclined steps being releasably securable by applying a relative twist action to the caps being connected or to the cap and ring portion being connected.

5. A cap according to claim 3, wherein the secondary cooperating engaging formations are press fit clipping formations, the teeth and the inclined steps being capable of releasably clipping to one another.

6. A cap according to claim 2, wherein the secondary internal cooperating engaging formations are press fit clipping formations, the teeth and the inclined steps being capable of releasably clipping to one another.

7. A cap according to claim 2, wherein the secondary cooperating engaging formations are twist fit formations, the teeth and the inclined steps being releasably securable by applying a relative twist action to the caps being connected or to the cap and ring portion being connected.

8. A cap according to claim 7, wherein the at least one ring portion includes primary external cooperating engaging formations such that before separation, the primary external cooperating engaging formations are provided on either side of the line of weakness.

9. A cap according to claim 8, wherein the cap is connectible in the side-to-side configuration to other caps, ring portions or to bottles having corresponding primary external cooperating engaging formations.

10. A cap according to claim 9, wherein the primary external cooperating engaging formations extend longitudinally on the sleeve in the form of consecutive male and female engaging formations.

11. A cap according to claim 10, wherein the male engaging formations are ridges extending radially outwardly from the cap and the female engaging formations are defined by the spacing between consecutive male engaging formations, the male engaging formations being slidably receivable within the female engaging formations for the purposes of connecting the cap to other caps, ring portions and/or bottles.

12. A cap according to claim 11, wherein the female engaging formations are wedge shaped grooves.

13. A cap according to claim 12, wherein the at least one line of weakness is castellated such that a castellated formation remaining on the cap and the ring portion after separation form the teeth of the secondary cooperating engaging formations.

14. A cap according to claim 13, wherein the at least one line of weakness is a transversely extending annular line of weakness.

15. A cap according to claim 14, wherein the ring portion comprises internal barbs to engage an annular protrusion around a bottle neck, such that when the cap is twisted for the purposes of opening the bottle, the bards resist the twist motion causing the cap to break along the line of weakness thereby providing a visual aid that the bottle and/or cap have been tampered with.

16. A cap according to claim 15, wherein the primary external cooperating engaging formations comprise sufficient strength to withstand breaking from the cap under forces the cap is exposable to during an automated bottle capping process.

17. A bottle comprising a cap according to claim 16.

18. A bottle according to claim 17, further including the primary external cooperating engaging formations such that the bottle is connectible side-to-side, via the primary external cooperating engaging formations, to other bottles, caps or ring portions.

19. A bottle according to claim 18, the bottle further including indicia advising consumers that a collection of bottles and/or caps can be used together as building components.

* * * * *